US006181897B1

(12) United States Patent
Kawai

(10) Patent No.: US 6,181,897 B1
(45) Date of Patent: Jan. 30, 2001

(54) DEVELOPING APPARATUS

(75) Inventor: Tachio Kawai, Odawara (JP)

(73) Assignee: Canon Kabushiki Kaisha, Tokyo (JP)

( * ) Notice: Under 35 U.S.C. 154(b), the term of this patent shall be extended for 0 days.

(21) Appl. No.: 09/425,227

(22) Filed: Oct. 22, 1999

(30) Foreign Application Priority Data

Oct. 27, 1998 (JP) ..... 10-321527

(51) Int. Cl.[7] ..... G03G 15/08
(52) U.S. Cl. ..... 399/103
(58) Field of Search ..... 399/102, 103, 399/105, 222, 265, 264

(56) References Cited

U.S. PATENT DOCUMENTS 4,596,455 * 6/1986 Kohyama et al. ..... 399/103
5,134,960 * 8/1992 Shirai ..... 399/105
5,502,547 * 3/1996 Shirai ..... 399/102
5,606,397 * 2/1997 Honda et al. ..... 399/222 X
5,794,101 * 8/1998 Watanabe et al. ..... 399/103
6,002,898 12/1999 Yokomori et al. ..... 399/119
6,044,237 * 3/2000 Numagami et al. ..... 399/105 X
6,047,150 * 4/2000 Kanno et al. ..... 399/103 X
6,070,027 * 5/2000 Kawai et al. ..... 399/103

* cited by examiner

*Primary Examiner*—Susan S. Y. Lee
(74) *Attorney, Agent, or Firm*—Fitzpatrick, Cella, Harper & Scinto

(57) ABSTRACT

A developing apparatus including a developing container provided with an opening portion, a developer bearing member, seal members, a flexible sheet member provided extending in a lengthwise direction of the developer bearing member and provided with overlapping portions overlapping the seal members in the lengthwise direction, and an auxiliary sheet member provided between the flexible sheet member and the developer bearing member and on at least the overlapping portions in the lengthwise direction.

11 Claims, 4 Drawing Sheets

PRIOR ART

DEVELOPING APPARATUS

BACKGROUND OF THE INVENTION

1. Field of the Invention

This invention relates to a developing apparatus usable in an image forming apparatus.

2. Related Background Art

In an image forming apparatus such as a printer using the electrophotographic process, an electrophotographic photosensitive member, e.g. a photosensitive drum, which is an image bearing member, is uniformly charged, an electrostatic latent image is formed by selective image exposure to the photosensitive drum, the latent image is developed by a developing apparatus by the use of a toner which is a developer, the obtained toner image is transferred to a recording medium, and further the transferred toner image is fixed on the recording medium by heat and pressure to thereby obtain an image on the recording medium.

Such an image forming apparatus involves the supply of the toner to the developing apparatus and the maintenance of various process means, and as a method of facilitating the work of replenishing the toner and the maintenance, it has been put into practical use to put the photosensitive drum, charging means, cleaning means and the like together into a frame body and make them into a cartridge (process cartridge) detachably attachable to the main body of the image forming apparatus, and to make the developing apparatus into a cartridge (developing cartridge).

This developing apparatus made into a cartridge is provided with a frame body constituting a developing container having an opening portion at one end thereof and containing a toner therein, a developing roller (developer bearing member) rotatably disposed in the opening portion and bearing the toner thereon and carrying it to the photosensitive drum, a developing blade (developer regulating member) for regulating the amount of the toner borne on the developing roller, end portion seal members for preventing the leakage of the toner in the lengthwise direction of the developing roller at both end portions of the opening portion, and a flexible sheet member for preventing the blowoff of the toner from the gap between itself and the developing roller and between itself and the end portion seal members.

The flexible sheet member is attached to the lower portion of the opening portion of the developing frame body, and one end portion thereof opposite to the attached side thereof is a free end which bears against the entire area of the lower portion of the peripheral surface of the developing roller in the lengthwise direction thereof. The length of the flexible sheet member in the lengthwise direction thereof is up to a position entering and overlapping the end portion seal members, whereby the gap between it and the developing roller and between it and the end portion seal members is closed in the lower portion of the opening portion to thereby prevent the toner from blowing off from there.

The aforedescribed flexible sheet member, however, is sandwiched between the developing roller and the end portion seal members in the portion thereof overlapping the end portion seal members, and this has led to the problem that the developing roller is rotated, whereby the flexible sheet member is gradually pulled inwardly and outwardly laterally in the lengthwise direction and is deformed into a waving shape.

That is, as shown in FIG. 6 of the accompanying drawings, by the rotation of the developing roller 102 in the direction of arrow A, the flexible sheet member 106 is horizontally pulled in the same direction of arrow B as the direction of rotation of the developing roller 102. However, besides the horizontal pulling force in the direction of arrow B, inwardly and outwardly directed horizontal forces in the direction of arrow C and the direction of arrow D are also applied to the flexible sheet member 106 due to the vibration of the developing roller 102 and the misalignment of the rotary shaft thereof. Particularly in the portion wherein the flexible sheet member 106 and the end portion seal member 105 overlap each other, the pressure force of the flexible sheet member 106 to the developing roller 102 becomes great due to the repulsion of the end portion seal member 105 and therefore, this portion is liable to be affected by the aforementioned pulling forces in the direction of arrow C and the direction of arrow D.

In this case, in the area of the overlapping portion between the flexible sheet member 106 and the end portion seal member 105 against which the developing roller 102 does not abut, any force which urges the flexible sheet member 106 toward the end portion seal member 105 side does not work from the developing roller 102 side and therefore, when the pulling forces in the direction of arrow C and the direction of arrow D (particularly the direction of arrow D) work on the flexible sheet member 106, the flexible sheet member 106 is deformed and waves in that direction.

If the flexible sheet member 106 waves, there is formed a gap between the developing roller 102 and the flexible sheet member 106 and the toner becomes liable to leak from the gap. This problem arises more remarkably particularly when a non-magnetic toner is used as the developer, because the restraint of the toner by a magnetic force cannot be done.

SUMMARY OF THE INVENTION

It is an object of the present invention to provide a developing apparatus in which the waving of a flexible sheet member is prevented.

It is another object of the present invention to provide a developing apparatus in which the scattering of a developer from between the lower portion of a developer bearing member and a developing container is prevented.

DESCRIPTION OF THE PREFERRED EMBODIMENTS

Some embodiments of the present invention will hereinafter be described in greater detail with reference to the drawings.

Embodiment 1

Figure 1:
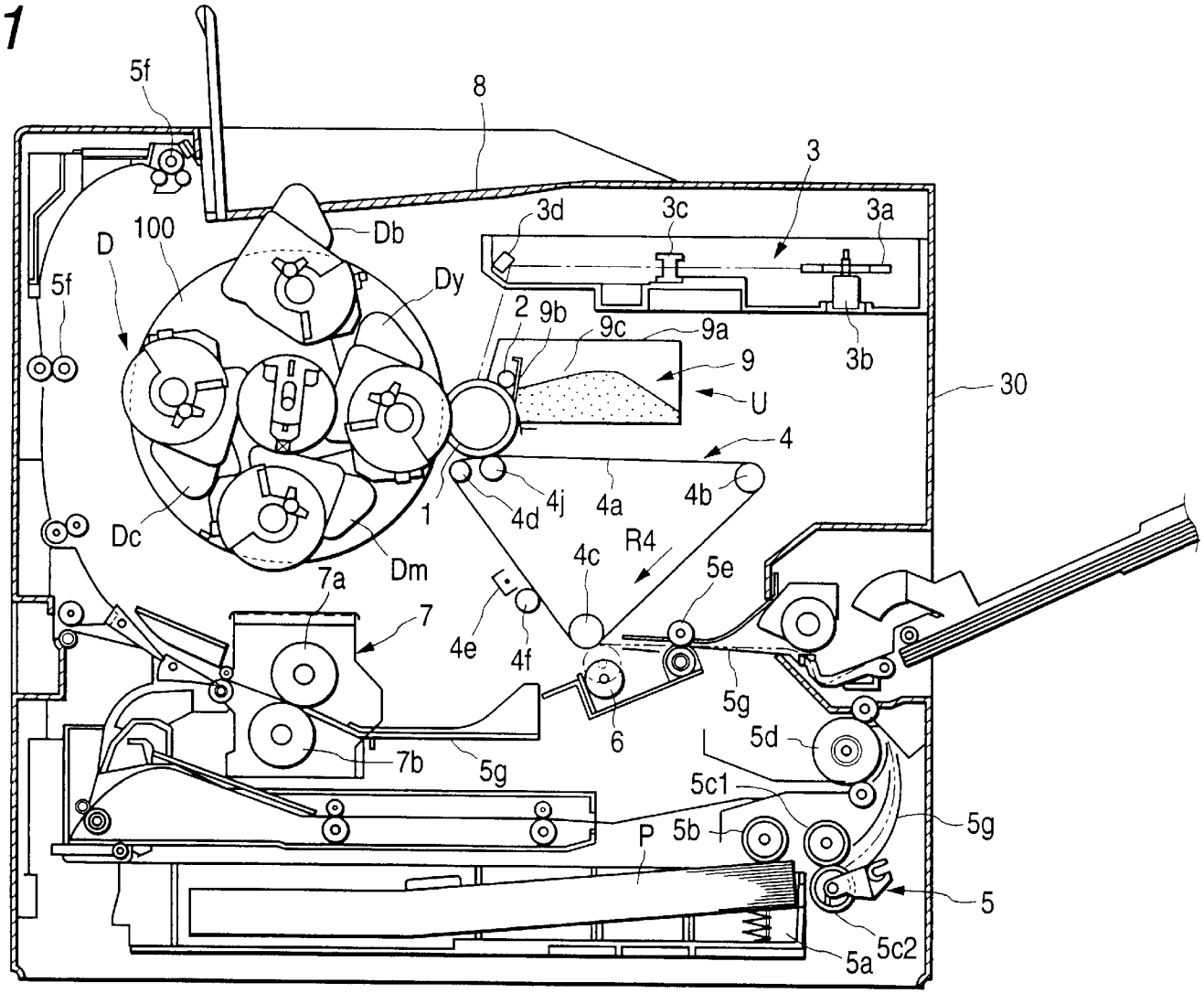
FIG. 1 shows the entire construction of an embodiment of the image forming apparatus of the present invention.

FIG. 1 shows the entire construction of an embodiment of the image forming apparatus of the present invention. This image forming apparatus is constructed as a color laser printer for forming color images by the electrophotographic method.

The color laser printer, as shown in FIG. 1, has an electrophotographic photosensitive member (photosensitive drum) 1 rotated at a predetermined speed as an image bearing member, and the surface of this photosensitive drum 1 is uniformly charged by charging means 2, and a laser beam conforming to image information is applied thereto from exposure means 3, whereby an electrostatic latent image is formed on the photosensitive drum 1, and this electrostatic latent image is developed by a developing apparatus of a color conforming to the latent image, and is visualized as a toner image.

In the present embodiment, developing apparatuses of respective colors, i.e., yellow, magenta, cyan and black, are constructed as developing cartridges D detachably attachable to the main body of the printer, i.e., a yellow developing cartridge Dy, a magenta developing cartridge Dm, a cyan developing cartridge Dc and a black developing cartridge Db.

The toner images of the respective colors successively formed on the photosensitive drum 1 in this manner are successively transferred to the surface of a belt-like intermediate transfer member, i.e., an intermediate transfer belt 4*a*, whereby a color image is formed on the intermediate transfer belt 4*a*. This color image is transferred to the surface of a recording medium (such as recording paper or an OHP sheet) P conveyed from a feeding portion by conveying means 5, by transfer means 6. The recording medium P is sent to fixing means 7, where the color image is fixed on the recording medium P, which is then discharged to a discharge portion 8 on the upper surface of the printer.

The construction of each portion of the image forming apparatus will now be described in detail.

The above-described photosensitive drum 1 and charging means 2, and cleaning means 9 are integrally made into a drum unit U which is a process cartridge. This drum unit U is supported detachably relative to the main body 30 of the printer, and the cartridge U is easily interchangeable by a user in accordance with the like of the photosensitive drum 1.

The photosensitive drum 1 comprises an aluminum cylinder having a diameter of about 50 mm and an organic photoconductive material layer applied to the outer peripheral surface of the aluminum cylinder, and is rotatably supported on the container-like frame member of the cleaning means 9 serving also as a holder. The photosensitive drum 1 is rotatively driven counter-clockwisely as viewed in FIG. 1 by a drive motor, not shown, in conformity with the image forming operation.

The charging means 2 is an electrically conductive roller using the contact charging method, and this electrically conductive roller 2 is brought into contact with the photosensitive drum 1 and a voltage is applied to the electrically conductive roller 2, whereby the surface of the photosensitive drum 1 is uniformly charged.

The exposure means 3 is such that when an image signal is given to a laser diode, not shown, this laser diode applies an image light corresponding to the image signal to a polygon mirror 3*a*. The polygon mirror 3*a* is rotated at a high speed by a scanner motor 3*b*, and the surface of the photosensitive drum 1 rotated at a predetermined speed is selectively exposed to the image light reflected by the polygon mirror 3*a* through the intermediary of an imaging lens 3*c* and a reflecting mirror 3*d*, whereby an electrostatic latent image is formed on the surface of the photosensitive drum 1.

This latent image is developed in each color by developing means, and the obtained toner image of each color is transferred to the surface of the intermediate transfer belt 4*a*.

Any untransferred toner remaining on the surface of the photosensitive drum 1 is scraped off by the cleaning blade 9*b* of the cleaning means 9 and is stored in a waste toner container 9*c* formed in the frame member 9*a*. The capacity of the waste toner container 9*c* is set so that waste toner stored therein may not fill the waste toner container 9*c* earlier than the life of the photosensitive drum 1. The waste toner in the waste toner container 9*c* is taken away with the process cartridge U by the interchange of the latter when the photosensitive drum 1 has reached the end of its life.

The intermediate transfer belt 4*a*, together with a drive roller 4*b*, a secondary transfer opposed roller 4*c* and a driven roller 4*d* over which the intermediate transfer belt is passed, and a holding roller 4*j* near the driven roller 4*d*, constitutes an intermediate transfer device 4 detachably attachable to the main body 30 of the printer. In the present embodiment, the intermediate transfer belt 4*a* is formed to a circumferential length of 440 mm.

The intermediate transfer belt 4*a* is moved in the direction of arrow R4 by the driving by the drive roller 4*b* and has toner images of respective colors successively primary-transferred thereto from the photosensitive drum 1, and also has a role as a secondary image bearing member for collectively secondary-transferring the primary-transferred toner images of plural colors to the recording medium P.

The above-mentioned holding roller 4*j* urges the intermediate transfer belt 4*a* against the photosensitive drum 1 during primary transfer, and is retracted to a position in which the intermediate transfer belt 4*a* separates from the photosensitive drum 1 after the completion of the primary transfer.

The secondary transfer of the toner images from the intermediate transfer belt 4*a* to the recording medium P is effected by a transfer roller 6 as transfer means. The transfer roller 6 comprises a metallic shaft covered with a foamed elastic material of medium resistance, and is installed for movement toward and away from the intermediate transfer belt 4*a*.

The transfer roller 6 is downwardly spaced apart from the intermediate transfer belt 4*a* as indicated by solid line in FIG. 1 so as not to disturb the toner images of the four colors while the toner images are being primary-transferred onto the intermediate transfer belt 4*a*. In timed relationship with the transfer of the toner images of the four colors from the intermediate transfer belt 4*a*, the transfer roller 6 is upwardly moved by a cam mechanism as indicated by dashed line in FIG. 1, and the transfer roller 6 is urged against the intermediate transfer belt 4*a* with the recording medium P interposed therebetween with predetermined pressure. At the same time, a bias voltage is applied to the transfer roller 6, and the toner images of the four colors on the intermediate transfer belt 4*a* are transferred to the recording medium P.

The conveying means 5, as shown in FIG. 1, is comprised of a sheet supply cassette 5*a* containing a plurality of recording mediums P therein, a pickup roller 5*b*, a feed roller 5*c*1, a retard roller 5*c*2 for preventing double feeding, a pair of conveying rollers 5*d*, a conveying guide 5*g*, a pair of registration rollers 5*e*, a conveying guide 5*g* and a pair of discharge rollers 5*f*.

During image formation, the pickup roller 5*b* is rotated in conformity with the image forming operation and separates and feeds the recording medium P in the sheet supply cassette 5*a* one by one. The recording medium P fed out of the sheet supply cassette 5*a* is guided by the conveying guide 5*g*, and the recording medium P is brought to the pair of registration rollers 5*e* via the pair of conveying rollers 5*d*. During the image forming operation, the non-rotating operation of making the recording medium P stationarily wait at the pair of registration rollers 5*e* and the rotating operation of conveying the recording medium P toward the intermediate transfer belt 4*a* are performed at a predetermined sequence.

Outside the intermediate transfer belt 4*a*, a cleaning unit 4*e* movable toward and away from the surface of the intermediate transfer belt 4*a* is provided at a predetermined location downstream of the secondary transfer portion. This cleaning unit 4*e* brings a charging roller 4*f* into contact with the surface of the intermediate transfer belt 4*a* after the completion of the secondary transfer, and gives charges opposite to those during transfer to the secondary-untransferred toners remaining on the surface of the intermediate transfer belt 4*a*. Thereby, the secondary-untransferred toners given the opposite charges electrostatically adhere to the photosensitive drum 1 and are collected by the aforementioned cleaning means 9.

The method of cleaning the intermediate transfer belt 4*a* is not limited to the above-described electrostatic cleaning, but may be a mechanical method using a blade, a fur brush or the like or a method using both of these.

The recording medium P to which the color image has been transferred is conveyed to the fixing means 7, whereby the toner image thereon is fixed. The fixing means 7 is comprised of a fixing roller 7*a* for applying heat to the recording medium P, and a pressing roller 7*b* for pressing the recording medium P against the fixing roller 7*a*. Each of the fixing roller 7*a* and the pressing roller 7*b* is formed by a hollow roller, and a heater is contained in the hollow portion thereof. The fixing roller 7*a* and the pressing roller 7*b* are rotatively driven at a predetermined speed and convey the recording medium P while applying heat and pressure thereto, thus fixing the toner image on the recording medium P.

The recording medium P having the toner image fixed thereon is discharged to the discharge portion 8 by the pair of discharge rollers 5*f* of the conveying means 5.

Description will now be made of the developing cartridges D in the present embodiment. As previously described, the developing apparatuses of the respective colors are made into the developing cartridges D (Dy, Dm, Dc and Db) detachably attachable to the main body of the printer. These developing cartridges D are carried on a cylindrical rotary 100, and by the rotation of the rotary 100, the developing cartridges D are successively conveyed to the developing position opposed to the photosensitive drum 1 and are used for development.

Figure 2:
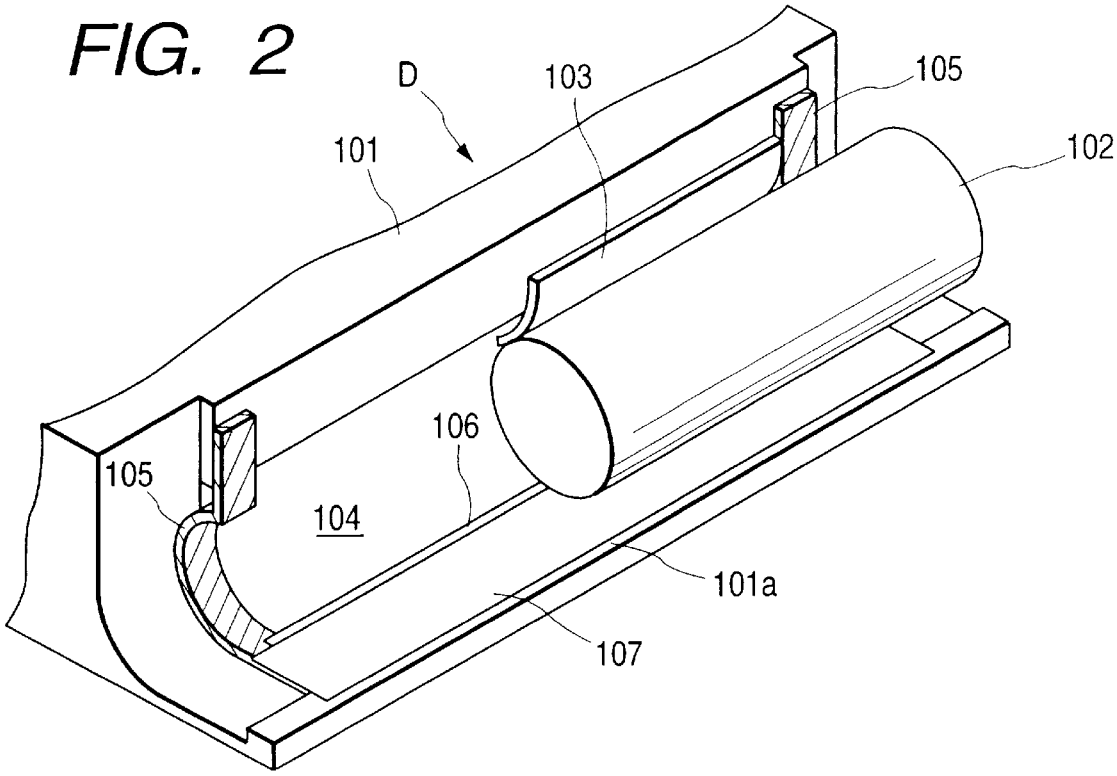
FIG. 2 is a perspective view showing an auxiliary sheet member as it is disposed in the opening portion of a developing cartridge installed in the image forming apparatus of FIG. 1.

The basic structure of each developing cartridge D is similar to that of the developing cartridge according to the prior art, and as shown in FIG. 2, is provided with a frame member 101 constituting a developing container containing a toner therein and having an opening portion 104 at one end thereof, a developing roller (developer bearing member) 102 rotatably disposed in the opening portion 104 for bearing the toner and carrying it to the photosensitive drum, a developing blade (developer regulating member) 103 for regulating the amount of the toner borne on the developing roller 102, end portion seal members 105 for preventing the leakage of the toner in the lengthwise direction of the developing roller 2 at the opposite ends of the opening portion 104, and a flexible sheet member 106 for preventing the blowoff of the toner from the gap between itself and the developing roller 102 and between itself and the end portion seal members 105 in the lower portion of the opening portion 104.

The flexible sheet member 106 is fixed to the surface 101*a* of the lower portion of the opening portion 104 of the developing frame member 101 by an adhesive agent, and is in contact with the entire lengthwise area of the lower portion of the peripheral surface of the developing roller 102 up to a position entering into the end portion seal members 105.

This flexible sheet member 106 is sandwiched between the developing roller 102 and the end portion seal members 105 in the portion thereof overlapping the end portion seal members 105, and this has heretofore led to the problem that by the developing roller 102 being rotated, the flexible sheet member is gradually pulled lengthwisely inwardly and outwardly whereby the flexible sheet member 106 is deformed into a waving shape.

So, in the present embodiment, an auxiliary sheet member 107 is interposed between the flexible sheet member 106 and the lower portion of the peripheral surface of the developing roller 102. This auxiliary sheet member 107 covers at least the lengthwise portions of the flexible sheet member 106 which overlap the end portion seal members 15, and one end of the auxiliary sheet member 107 is fixed to the lower part of the opening portion 104 of the developing frame member 101.

In the present embodiment, the auxiliary sheet member 107 comprises a sheet member continued to the lengthwise direction of the flexible sheet member 106. This auxiliary sheet member 107 is fixed to the same surface 101*a* of the lower part of the opening portion 104 of the developing frame member 101 as the part to which the flexible sheet member 106 is fixed.

According to this, the developing roller 102 does not directly contact with the flexible sheet member 106 due to the interposition of the auxiliary sheet member 107 and therefore, the flexible sheet member 107 does not receive the pulling force resulting from the rotation of the developing roller 102 and thus, the portions of the flexible sheet member 106 which overlap the end portion seal members 105 can be prevented from waving. As the result, any gap can be prevented from being created between the end portion seal members 105 and the developing roller 102, and the scattering of the toners can be reduced.

Embodiment 2

Figure 3:
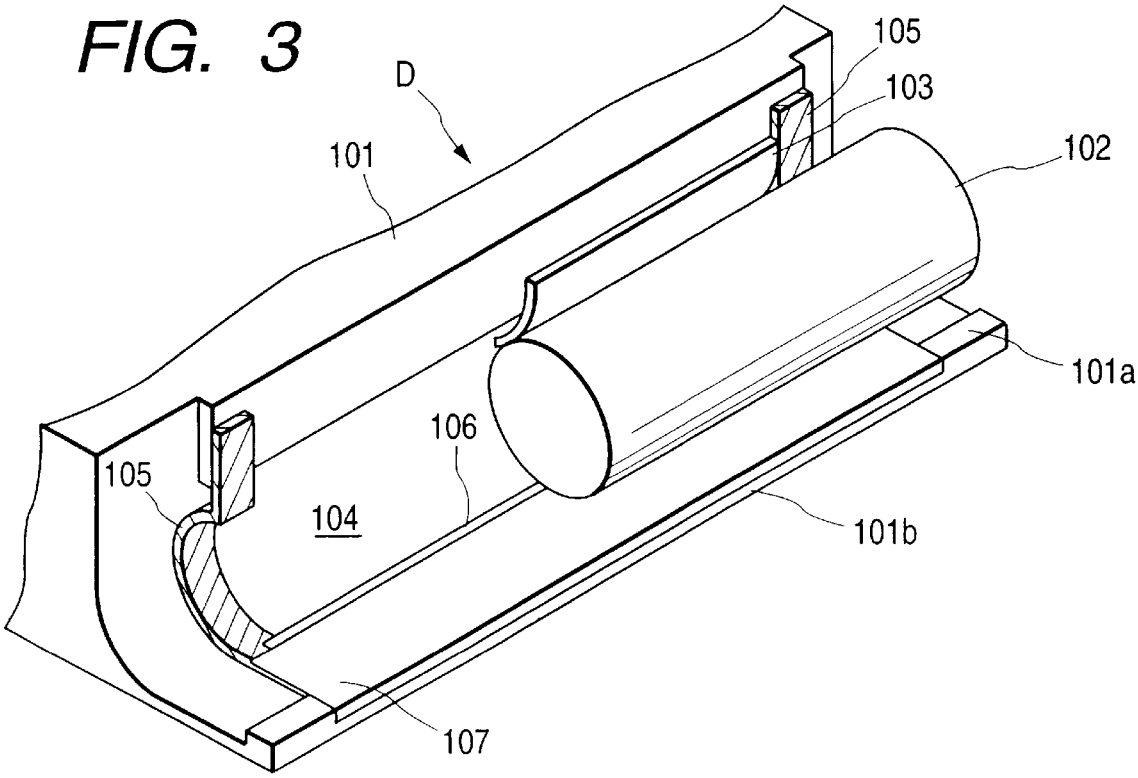
FIG. 3 is a perspective view showing the disposition of a auxiliary sheet member in another embodiment of the present invention.

In this embodiment, as shown in FIG. 3, the auxiliary sheet 107 is fixed to the side 101*b* of the lower part of the opening portion 104 of the developing frame member 101 which differs from the surface 101*a* to which the flexible sheet member 106 is fixed by an adhesive agent. In the other points, this embodiment is the same as Embodiment 1.

Again in the present embodiment, the waving of the flexible sheet member 106 can be prevented from occurring in the portions thereof overlapping the end portion seal members 105 to thereby prevent any gap from being created between the end portion seal members 105 and the developing roller 102, and reduce the scattering of the toners.

Embodiment 3

Figure 4:
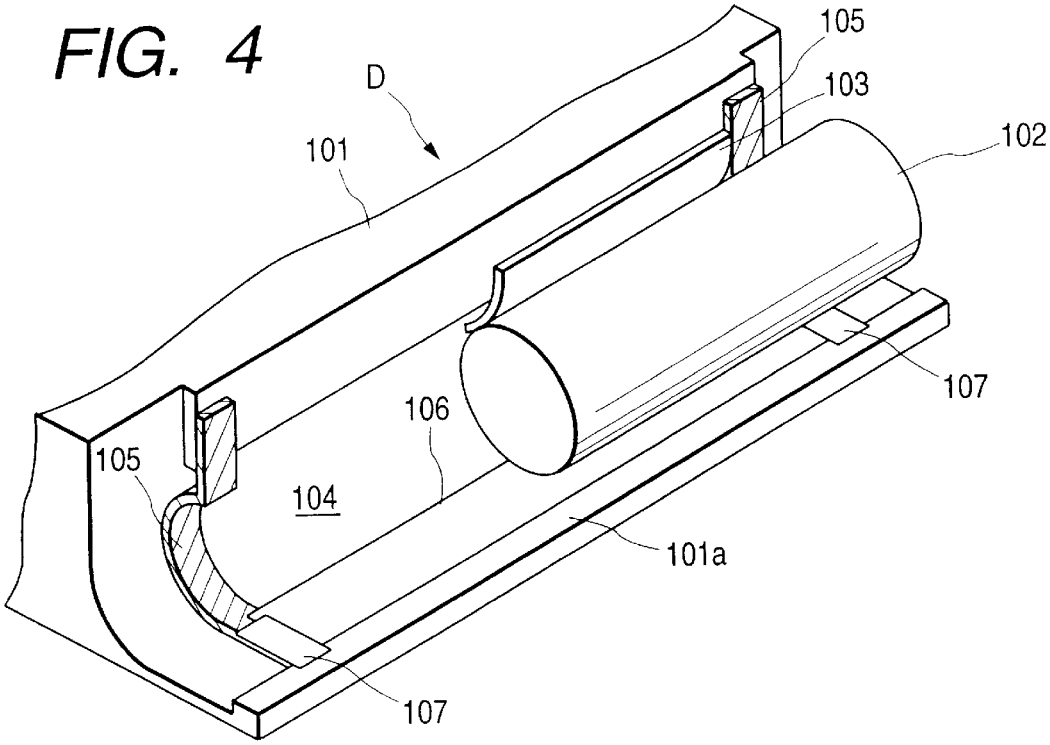
FIG. 4 is a perspective view showing the disposition of an auxiliary sheet member in still another embodiment of the present invention.

In this embodiment, as shown in FIG. 4, the auxiliary sheet members 107 are provided only on the lengthwisely opposite end portions of the flexible sheet member 106 so as to cover only the overlapping portions between the flexible sheet member 106 and the end portion seal members 105, and are disposed between the flexible sheet member 106 and the lower portion of the peripheral surface of the developing roller 102. One end of the auxiliary sheet member 107 is fixed to the lower part 101*a* of the opening portion 104 of the frame member 101 to which the flexible sheet member 106 is fixed.

Again in the present embodiment, the waving of the flexible sheet member 106 can be prevented from occurring in the portions thereof overlapping the end portion seal members 105 to thereby prevent any gap from being created between the end portion seal members 105 and the developing roller 102, and reduce the scattering the toners.

Embodiment 4

Figure 5:
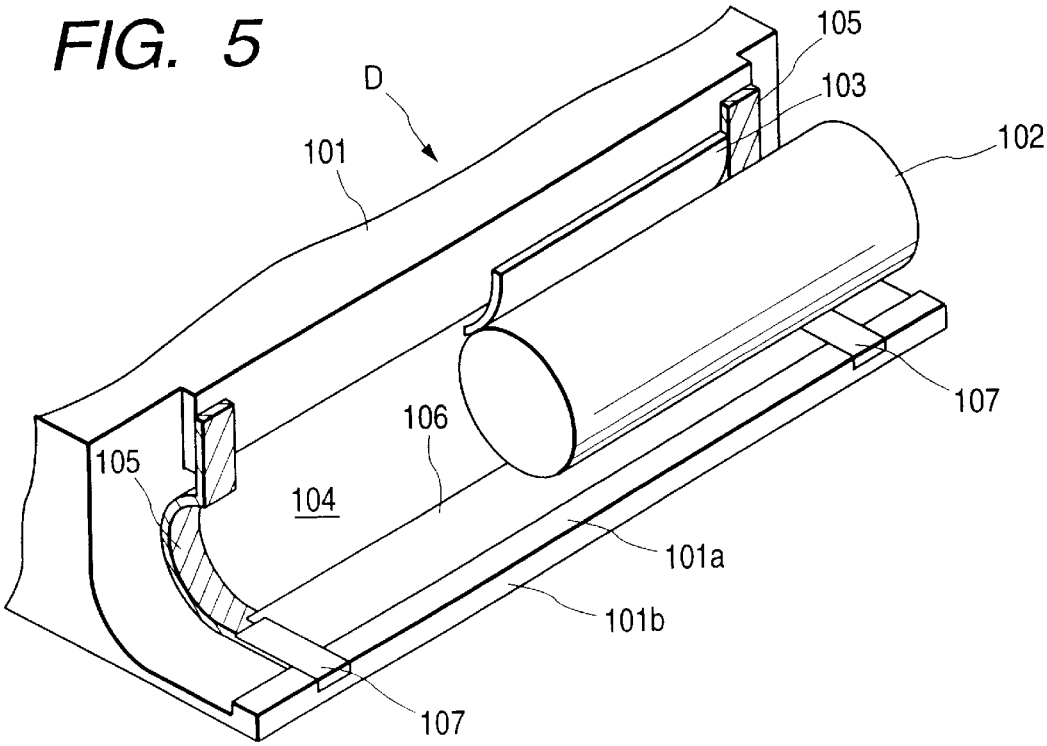
FIG. 5 is a perspective view showing the disposition of an auxiliary sheet member in yet still another embodiment of the present invention.
Figure 6:
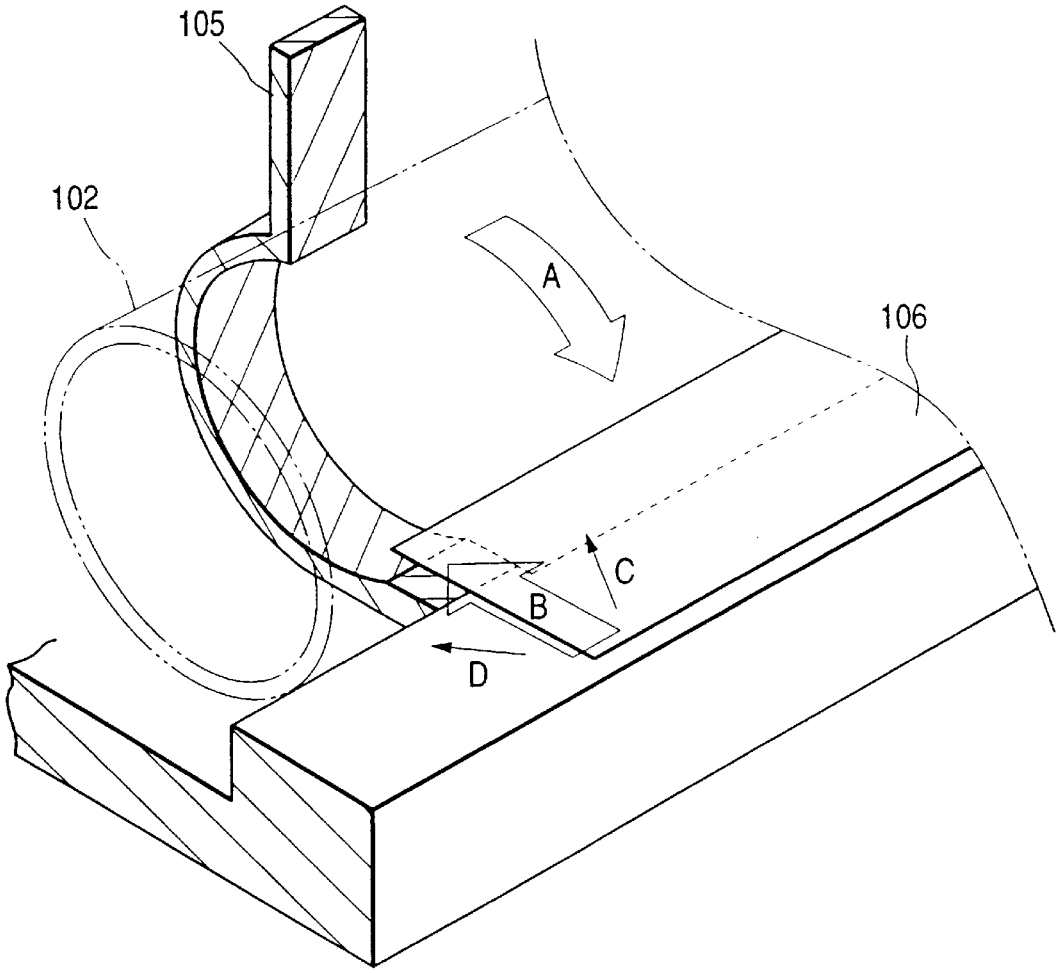
FIG. 6 is a perspective view illustrating the mechanism with which a flexible sheet member is waved by the rotation of a developing roller disposed in the opening portion of a developing cartridge according to the prior art.

This embodiment is such that in Embodiment 3, as shown in FIG. 5, the auxiliary sheet 107 is fixed to the side 101*b* of the lower part of the opening portion 104 of the developing frame member 101 which differs from the surface 101*a* to which the flexible sheet member 106 is fixed, by an adhesive agent. In the other points, the present embodiment is the same as Embodiment 3.

Again in the present embodiment, the waving of the flexible sheet member 106 can be prevented from occurring in the portions thereof overlapping the end portion seal members 105 to thereby prevent any gap from being created between the end portion seal members 105 and the developing roller 102, and reduce the scattering of the toners.

While in the above-described embodiments, the developing apparatuses have all been described with respect to the developing cartridges provided in the laser beam printer, the present invention can also be applied to developing apparatuses which do not adopt the cartridge system. Also, the image forming apparatus can be applied not only to a printer, but image forming apparatuses such as a copying machine, a facsimile apparatus and a word processor.

What is claimed is:

1. A developing apparatus comprising:

a developing container provided with an opening portion;

a developer bearing member provided rotatably in said opening portion and bearing and carrying a developer thereon;

seal members contacting with end portions in a lengthwise direction of said developer bearing member and preventing leakage of the developer;

a flexible sheet member contacting with said developer bearing member to prevent leakage of the developer from an area between a lower portion of said developer bearing member and said developing container, and supported on said developing container, said flexible sheet member being provided extending in the lengthwise direction, and being provided with overlapping portions overlapping said seal members in the lengthwise direction, a portion of said flexible sheet member being provided between said developer bearing member and said seal members in said overlapping portions; and an auxiliary sheet member provided between said flexible sheet member and said developer bearing member and on at least said overlapping portions in the lengthwise direction.

2. A developing apparatus according to claim 1, wherein said auxiliary sheet member is supported on said developing container.

3. A developing apparatus according to claim 2, wherein said flexible sheet member and said auxiliary sheet member are supported on the same surface of said developing container.

4. A developing apparatus according to claim 2, wherein a surface on which said auxiliary sheet member is supported by said developing container differs from a surface on which said flexible sheet member is supported by said developing container.

5. A developing apparatus according to claim 1, wherein said auxiliary sheet member is provided from a central portion to end portions of said flexible sheet member in the lengthwise direction.

6. A developing apparatus according to claim 1, wherein said auxiliary sheet member is provided only on end portions of said flexible sheet member in the lengthwise direction.

7. A developing apparatus according to claim 1, wherein the developer is a non-magnetic monocomponent developer.

8. A developing apparatus according to any one of claims 1 to 7, which is detachably attachable to a main body of an image forming apparatus.

9. A developing apparatus according to any one of claims 1 to 7, wherein, together with an image bearing member, said apparatus constitutes a process cartridge detachably attachable to a main body of an image forming apparatus.

10. A developing apparatus according to claim 9, wherein said image bearing member is an electrophotographic photosensitive member.

11. A developing apparatus according to any one of claims 1 to 7, wherein said apparauts is provided in an image forming apparatus.

* * * * *

UNITED STATES PATENT AND TRADEMARK OFFICE

CERTIFICATE OF CORRECTION

PATENT NO. : 6,181,897 B1
DATED : January 30, 2001
INVENTOR(S) : Tachio Kawai

It is certified that error appears in the above-identified patent and that said Letters Patent is hereby corrected as shown below:

Column 2,
Line 49, "a" (second occurrence) should read -- an --.

Column 6,
Line 40, "contact" should read -- make contact --.

Column 7,
Line 15, "scattering" should read -- scattering of --.

Column 8,
Line 47, "apparauts" should read -- apparatus --.

Signed and Sealed this

Thirteenth Day of November, 2001

*Attest:*

Nicholas P. Godici

NICHOLAS P. GODICI
*Acting Director of the United States Patent and Trademark Office*

*Attesting Officer*